US005421151A

United States Patent [19]

Fehrer

[11] Patent Number: 5,421,151

[45] Date of Patent: Jun. 6, 1995

[54] APPARATUS FOR MAKING YARN

[76] Inventor: Ernst Fehrer, Auf der Gugl 28, A-4020 Linz, Austria

[21] Appl. No.: 201,727

[22] Filed: Feb. 25, 1994

Related U.S. Application Data

[63] Continuation of Ser. No. 949,698, Sep. 23, 1992, abandoned.

[30] Foreign Application Priority Data

Sep. 26, 1991 [AT] Austria ..... 1935/91

[51] Int. Cl.[6] ..... D01H 4/16

[52] U.S. Cl. ..... 57/408; 57/352; 57/417

[58] Field of Search ..... 57/401, 404, 417, 352, 57/315, 328, 5, 408

[56] References Cited

U.S. PATENT DOCUMENTS

| | | | |
|---|---|---|---|
| 4,070,811 | 1/1978 | Fehrer | 57/401 |
| 4,202,163 | 5/1980 | Turk et al. | 57/401 |
| 4,249,368 | 2/1981 | Fehrer | 57/5 |
| 4,334,400 | 6/1982 | Fehrer | 57/5 |
| 4,420,928 | 12/1983 | Fehrer | 57/401 |
| 4,524,580 | 6/1985 | Fehrer | 57/5 X |
| 4,539,806 | 9/1985 | Stahlecker | 57/401 |
| 4,574,572 | 3/1986 | Fehrer | 57/401 X |
| 4,628,679 | 12/1986 | Stadler et al. | 57/401 |
| 4,672,800 | 6/1987 | Fehrer | 57/5 |
| 4,779,410 | 10/1988 | Fehrer | 57/5 X |
| 4,783,956 | 11/1988 | Stadler | 57/401 |
| 4,787,198 | 11/1988 | Stahlecker | 57/401 |

FOREIGN PATENT DOCUMENTS

| | | | |
|---|---|---|---|
| 0175862 | 4/1986 | European Pat. Off. . | |
| 361814 | 4/1981 | Germany | 57/5 |

*Primary Examiner*—Daniel P. Stodola
*Assistant Examiner*—William Stryjewski
*Attorney, Agent, or Firm*—Collard & Roe

[57] ABSTRACT

An apparatus for making a yarn comprises two pairs of conveying rollers for defibrating at least one fibrous roving, two juxtaposed, closely spaced twisting drums, which succeed the conveying rollers and define a generally triangular twisting space, to which suction is applied and withdrawing rollers for withdrawing the yarn made from the fibers twisted in the triangular twisting space. To ensure desirable spinning conditions in such an apparatus, it is proposed that the two pairs of conveying rollers, which pairs immediately succeed each other, the conveying rollers of the receiving pair, which are remote from the triangular twisting space, define a clamping nip, form a delivering pair of rollers are nearer to the triangular twisting space and defining a guiding nip of rollers permits a slip relative to the fibers, and delivering pair are arranged to be driven at a higher peripheral velocity than the conveying rollers of the receiving pair but not in excess of the velocity of yarn formation.

3 Claims, 1 Drawing Sheet

APPARATUS FOR MAKING YARN

This is a continuation of my U.S. patent application Ser. No. 07/949,698, filed Sep. 23, 1992, now abandoned.

BACKGROUND OF THE INVENTION

1. Field of the Invention

This invention relates to an apparatus for making a yarn, comprising defibrating means for defibrating at least one fibrous roving, two juxtaposed, closely spaced twisting drums, which succeed the defibrating means and define a generally triangular twisting space, to which suction is applied, and withdrawing means, which axially succeed the twisting drums and serve to withdraw the twisted yarn made from the singled fibers in said twisting space.

2. Description of the Prior Art

A desirable spinning operation can be performed in a generally triangular twisting space between two closely spaced twisting drums, which are rotated in the same sense and exert a suction adjacent to the line of yarn formation. For that operation the singled fibers to be spun must be delivered to the twisting space in such a manner that the fibers can be twisted to form a yarn. For that purpose it is known to throw off the singled fibers from the serrated defibrating cylinder of defibrating means into the twisting space although the fibers cannot be aligned in that case. In that connection it must be taken into account that for a uniform twisting of the fibers it is desired that the fibers are parallel to each other and desirably extend in the direction of the line of yarn formation. For this reason it has been suggested to provide between the defibrating means and the twisting space a fiber-guiding passage, which is inclined by a small angle from the line of yarn formation and which will be affected by the suction stream flowing through the suction zones of the twisting drums so that an entraining air stream will be produced within the fiber-guiding passage and will align the fibers in the longitudinal direction of the passage. That known delivery of the fibers to the twisting space has the disadvantage that owing to the high velocity at which the fibers are conveyed the fibers are upset as they impinge on the fibers which have been joined in the yarn being formed and such upsetting will necessarily result in irregularities so that the strength of the yarn which can be achieved will be reduced.

It has been proposed (EP-A-175 862) to avoid said disadvantages in that the fiber-guiding passage is directed toward that twisting drum which rotates toward the twisting space, the yarn is withdrawn from the twisting space opposite to the feeding direction of the fiber-guiding passage, and the velocity of flow of the entraining air in the fiber-guiding passage is selected to be at a certain ratio to the peripheral velocity of the twisting drums. But these measures do not permit high-strength yarns to be spun under conditions in which the requirements for the twisting of the yarn are taken into account.

SUMMARY OF THE INVENTION

For this reason it is an object of the invention to avoid said disadvantages and to provide an apparatus which is of the kind described first hereinbefore and is so improved with simple means that uniform yarns of high strength can be made.

In accordance with the invention, the defibrating means for defibrating the fibrous roving are disposed above the triangular twisting space and consist of two pairs of conveying rollers, which pairs immediately succeed each other, the conveying rollers of the receiving pair, which are remote from the triangular twisting space, define a clamping nip, the conveying rollers of the delivering pair, which are nearer to the triangular twisting space, define a guiding nip, which permits a slip relative to the fibers, and the conveying rollers of the delivering pair are arranged to be driven at a higher peripheral velocity than the conveying rollers of the receiving pair but not in excess of the velocity of yarn formation.

Because the conveying rollers of the receiving pair, which are remote from the twisting space, define a clamping nip, by which the fibers of the roving are retained, the conveying rollers of the succeeding, delivering pair of the defibrating means cannot forward the singled fibers of the roving until they have left the clamping nip of the conveying rollers of the receiving pair. Because the conveying rollers of the delivering pair rotate at a higher peripheral velocity than the rollers of the receiving pair, the fibers which have been forwarded by the rollers of the delivering pair are separated from the fibers of the roving which is restrained by the rollers of the receiving pair and the fibers are thus singled. To ensure that the different peripheral velocities of the rollers of the two pairs will not result in a breakage of fibers, the guiding nip between the rollers of the delivering pair must not effect a slip-proof clamping of the fibers, as is effected by the rollers of the receiving pair, but must permit a slip relative to the fibers. This can be achieved, e.g. by the use of smooth steel rollers. On the other hand, a rubber roller and a steel roller, which preferably has longitudinal flutes, desirably cooperate in the receiving pair of rollers.

Because the peripheral velocity of the rollers of the delivering pair is adapted to the velocity of yarn formation, the singled fibers will be delivered to the yarn being formed at such a velocity that the fiber heads will not be upset as they engage the fibers joined in the yarn. The yarn will be formed at a velocity which highly depends on the velocity at which the yarn is withdrawn, and the velocity at which the yarn is twisted may also be significant. As a result, it is possible to make yarns which are highly uniform and have a high strength, particularly because the parallel orientation which has been effected by the singling of the fibers will not be disturbed by the delivery of the fibers to the triangular twisting space if the conveying rollers of the delivering pairs are disposed closely above the triangular twisting space.

For that purpose the conveying rollers of the delivering pair may be smaller in diameter than the conveying rollers of the receiving pair. With such size relationship, the two pairs of conveying rollers may be arranged in a tapering flow passage, which opens into the triangular twisting space, and in such a manner that a flow gap is left between the side walls of the passage and peripheral surfaces of the rollers. That flow passage may desirably influence the delivery of the fibers into the triangular twisting space because the air which is sucked into the triangular twisting space is compelled to flow along the side walls of the passage into the triangular twisting space.

DETAILED DESCRIPTION OF THE PREFERRED EMBODIMENT

Figure 1:
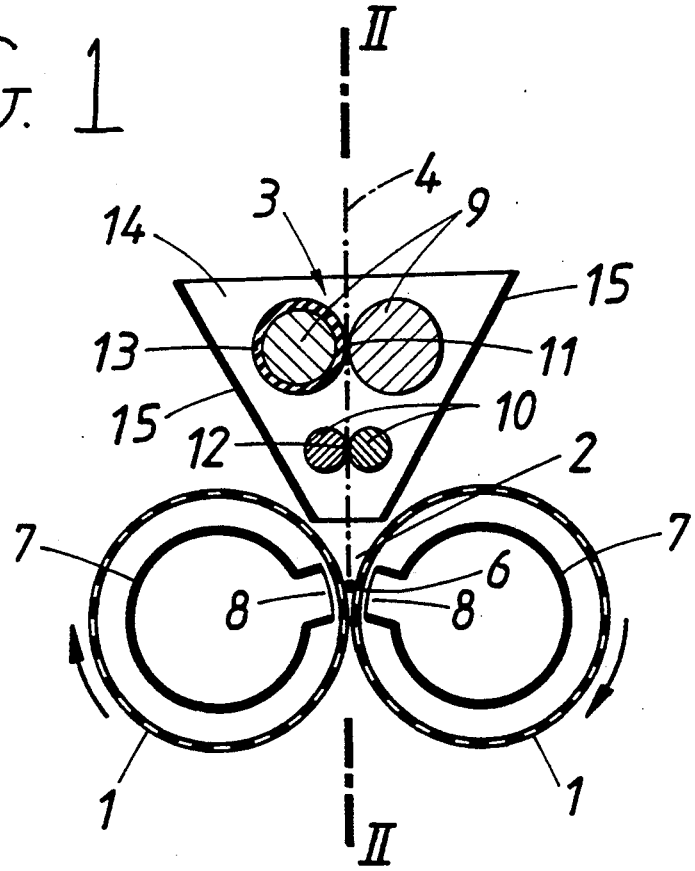
FIG. 1 is a simplified transverse sectional view showing an apparatus in accordance with the invention for making a yarn.
Figure 2:
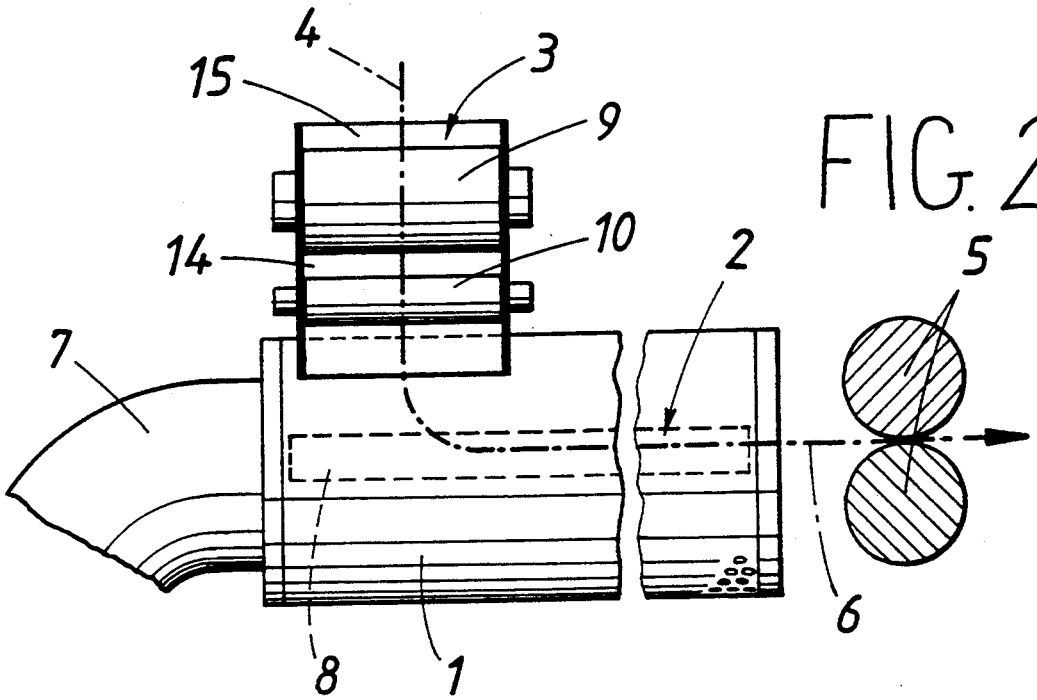
FIG. 2 is a longitudinal sectional view that is taken on line II—II in FIG. 1 and shows that apparatus.

An illustrative embodiment of the invention will now be described with reference to the drawing.

The illustrated apparatus for making a yarn essentially comprises two juxtaposed, closely spaced twisting drums 1, which rotate in the same sense and between themselves define a generally triangular twisting space 2. The apparatus also comprises defibrating means 3 for defibrating at least one fibrous roving 4 being supplied and means 5 for withdrawing the yarn 6 which has been formed. The twisting drums 1 have an air-permeable shell and are provided each with a suction insert 7, which defines a suction zone 8 adjacent to the line of yarn formation so that the suction streams through the suction zones 8 will cause the yarn 6 as it is formed to be sucked into the twisting space 2 and to contact both twisting drums 1 at the same time and to be twisted between the twisting drums.

The defibrating means 3 for defibrating the roving 4 being supplied comprise a receiving pair of conveying rollers 9 and a delivering pair of conveying rollers 10. The peripheral surfaces of the conveying rollers 9 of the receiving pair define between them a clamping nip 11, in which the fibers of the roving 4 are clamped against slipping. The peripheral surfaces of the conveying rollers of the delivering pair define between them a guiding nip 12, which permits a slip between the rollers and the fibers. The conveying rollers 9 of the receiving pair comprises a roller that has a rubber covering 13 and cooperates with a steel roller, which is preferably longitudinally fluted so that the fibers will reliably be clamped. On the other hand, the pair of rollers 10 consist of smooth steel rollers.

As is clearly apparent from FIG. 1 the rollers 9 of the receiving pair are larger in diameter than the rollers 10 of the delivering pair. This will permit the distance between the clamping nip 11 and the guiding nip 12 to be desirably reduced and will permit the rollers 10 of the delivering pair to be arranged closely above the triangular twisting space 2 so that the length in which the singled fibers fly freely between the defibrating means 3 and the line of yarn formation may be short. Besides, a flow passage 14 may be provided, which accommodates the rollers 9 and 10 of the two pairs and leaves a sufficient flow gap between the side walls 15 of the passage and the peripheral surfaces of the adjacent rollers.

To ensure desirable spinning conditions, the singled fibers must smoothly contact the yarn 6 being formed. For this reason the velocity at which the fibers are delivered to the triangular twisting space must not exceed the velocity of yarn formation, which will depend on the velocity at which the yarn is withdrawn and possibly also on the twisting of the yarn if the adaptation to the velocity of yarn withdrawal alone is not sufficiant. The required velocity of fiber delivery can readily be determined empirically unless values based on experience are available. The fibers may be delivered at a velocity which is slightly lower than that of the yarn withdrawal as long as the contacting of the fibers with the yarn is not adversely affected. A higher velocity of yarn withdrawal will exert an additional aligning action on the singled fibers.

In order to maintain such conditions, the conveying rollers 10 of the delivering pair adjacent to the triangular twisting space are driven at a higher peripheral velocity than the rollers of the receiving pair but not in excess of the velocity of yarn formation. That relatively large difference between the velocities is required for the singling of the fibers because the conveying rollers 10 of the delivering pair should pull the fibers which are joined in the fibrous roving 4 as it is restrained by the rollers 9 of the receiving pair and that pulling should be effected as soon as the trailing end of each fiber leaves the clamping nip 11 between the rollers 9.

I claim:

1. In an apparatus for making a yarn, comprising defibrating means for defibrating at least one fibrous roving into single fibers, two juxtaposed, closely spaced twisting drums defining between them a generally triangular twisting space arranged to receive only said single fibers from said defibrating means, said drums being operable to twist said single fibers in said twisting space to form a yarn consisting solely of said single fibers at a predetermined velocity of yarn formation, and withdrawing means for axially withdrawing said yarn from said twisting space, the velocity of yarn formation being the vector sum of a first vector consisting of the velocity at which the yarn is withdrawn and a second vector consisting of the velocity at which the yarn is twisted, the improvement comprising two consecutive pairs of conveying rollers disposed above said twisting space and constituting said defibrating means, one of the pairs being a receiving pair remote from said twisting space and the other one of said pairs being a delivering pair nearer to said twisting space, said rollers of said receiving pair having peripheral surfaces defining between them a clamping nip, said rollers of said delivering pair having peripheral surfaces defining between them a guiding nip permitting a slip relative to said fibers, and said rollers of said delivering pair being arranged to be operated at a higher peripheral velocity than the rollers of said receiving pair but not in excess of said velocity of yarn formation.

2. The improvement set forth in claim 1, wherein said rollers of said delivering pair are smaller in diameter than said rollers of said receiving pair.

3. The improvement set forth in claim 2, comprising means defining a flow passage which tapers toward and opens into said twisting space and in which said two pairs of conveying rollers are accommodated, the flow passage being defined by side walls disposed adjacent to and spaced from the peripheral surfaces of said conveying rollers.

* * * * *